US005934190A

United States Patent [19]

Jessup et al.

[11] Patent Number: 5,934,190

[45] Date of Patent: Aug. 10, 1999

[54] EXTRUDED PLASTIC SCREEN PRINTING FRAME PROTECTOR WITH INTEGRAL HINGED ARM

[75] Inventors: Charles M. Jessup, 568 Ocean Ave., Sea Bright, N.J. 07760; Jack Wegener, Preston, Md.

[73] Assignee: Charles M. Jessup, Sea Bright, N.J.

[21] Appl. No.: 09/044,871

[22] Filed: Mar. 20, 1998

[51] Int. Cl.[6] ..... B41F 15/34

[52] U.S. Cl. ..... 101/127.1

[58] Field of Search ..... 101/127, 127.1, 101/128.1, 128.21

[56] References Cited

U.S. PATENT DOCUMENTS

| | | | |
|---|---|---|---|
| 4,023,488 | 5/1977 | Zimmer | 101/127.1 |
| 4,060,030 | 11/1977 | Noschese | 101/127.1 |
| 5,224,418 | 7/1993 | Simmons | 101/127 |
| 5,306,376 | 4/1994 | James | 101/128.1 |
| 5,327,828 | 7/1994 | Barocas et al. | 101/127.1 |

FOREIGN PATENT DOCUMENTS

| | | | |
|---|---|---|---|
| 2087311 | 5/1982 | United Kingdom | 101/128.1 |

*Primary Examiner*—Edgar Burr
*Assistant Examiner*—Leslie Grohusky
*Attorney, Agent, or Firm*—Sughrue, Mion, Zinn, Macpeak & Seas, PLLC

[57] ABSTRACT

A unitary, thin wall, pliable extruded plastic frame and mesh protector for protecting a circular screen printing frame member and a screen mesh in contact therewith includes integrally a circular cross-section body portion having a radius R corresponding to the exterior radius of the frame member, extends about 270°, and is sized to the outer periphery of the frame member. An integral base portion extends from a first end of the body portion outwardly and tangentially therefrom. A straight arm portion may extend from a second end of the body portion, at an angle of about 45° to the tangent thereto toward a plane defined by a printing screen mesh whose peripheral edge overlies the base portion. A first hinge couples a proximate end of the arm portion to the second end of the body portion to facilitate pivoting of a distal end of the arm portion into contact with the facing surface of the printing screen mesh. The arm portion may be of a length equal to a hypothenuse of a right triangle whose opposite sides are of a length equal to the radius R.

19 Claims, 2 Drawing Sheets

EXTRUDED PLASTIC SCREEN PRINTING FRAME PROTECTOR WITH INTEGRAL HINGED ARM

FIELD OF THE INVENTION

This invention relates to screen printing, and more particularly to an extruded plastic screen printing frame and mesh protector with an integral hinged arm.

BACKGROUND OF THE INVENTION

Screen printing originated in China and Japan circa 500 AD using woven silk as the printing mesh to implant the image to be reproduced. The screen printing process is used to apply designs on T-shirts, fabrics for clothing and other textiles as well as for posters, signs, wallpaper, wood, instrument panels nomenclature, watch dials, plastic bottles and cans, and more recently printing conductive circuits for the electronics industry. Screen printing provides a means to uniquely apply a controlled thickness of media to various substrates with many industrial applications. The printing screen is no longer made with "silk" but has been replaced by a variety of fabrics, from course 25 mesh to fine weaves of over 500 threads per inch and many man made fibers such as nylon, polyester, metal clad polyester and even stainless steel wire cloth. The printing screen is usually held in place by a rigid frame commonly of rectangular configuration on which the mesh has been stretched taunt. Newer tubular frames of light weight metal such as aluminum have increasingly become replacements for wooden screens of rectangular cross-section. Screen printing frames of metal with printing screen mesh attached are subject to physical abuse and are often mishandled even during image processing. As a result, the printing screens are subject to tearing or puncturing during such abuse particularly under or near the metal tubular frame area. In use, the screens may become frayed, or torn and the printing frames nicked with burrs that would tear the fine mesh.

Additionally, silk screening is a very messy process, using various media, such as ink, paint or coatings, which flow easily, of a higher viscosity than water and generally of a consistency of a syrup-like molasses. The older style screen printing frames made from wood included vertical walls which easily contained the paint and simplified the screen frame cleanup when the screen printing job was finished. With the new tubular frames the void under the round tubular frame harbors the paint, renders cleanup tedious, if not impossible to remove all traces of ink and very time-consuming. Further, considerable paint finding its way into these areas is not efficiently used, and the screen printing operation ends up with a significant amount of wasted paint or media. To alleviate this problem, the voids were initially covered up with masking tape, having one edge in contact with the tubular metal frame, and the other in contact with the facing surface of the printing screen mesh. Such was found to be unsatisfactory since the tape would come loose and the paint would then flow into the voids and consequently leak out of any open areas of the mesh that are not covered or blocked out near the frame members. Also when removing the tape, it can delaminate and the adhesive remains on the metal frame leaving a sticky residue that is difficult to remove.

Attempts have been made to protect the printing screen and the frame, both from physical abuse and from the flow of printing ink along the periphery into the area of the frames. U.S. Pat. No. 5,327,828 to Earvin V. Barocas et al. issued Jul. 12, 1994 and entitled "CLAMP AND PROCESS FOR PROTECTING PRINTING SCREENS AND FRAMES" provides an extruded plastic screen printing frame protector which seeks to protect the vulnerable areas of the frame and mesh from tearing, while additionally protecting and extending the useful life of the printing screen and frame. In a preferred embodiment of the Barocas et al. patent, a tubular, annular body portion forms a frame engageable clamping member as a resilient impact-resistant bight portion which extends at least about 270° and is shaped complementary to a portion of the contour of the frame member so that the clamp snaps onto and matingly engages the frame member. The relatively thick, highly resilient bight portion is forcibly opened to permit its receiving the frame member internally, whereupon release of the clamping member functions to compressively engage the tubular frame member upon contracting of the open mouth which must be expanded prior to engaging about the frame member. Extending from the arcuate bight portion are a pair of V-shaped leg portions which extend diagonally inward toward each other and which contact each other at the outer free edges of the lips so as to engage and clamp the printing screen. In commercial practice, the Barocas clamp was found to be incapable of pressing on both the frame and the printing screen simultaneously. If effective to clamp onto the frame member, the free edges of the lips could not effectively clamp to opposite sides of the printing screen since there is a lack of pressure being applied to or between the lips, and the lips are separated so they cannot possibly clamp the printing screen. Vice-versa, if the printing screen were clamped resiliently between the edges of the lips, the bight of the clamp would be uncompressed to the exterior of the frame member. Thus, the dual and simultaneous clamping action as described in U.S. Pat. No. 5,327,828 is a physical and mechanical anomaly. In addition, the excessive length of the clamping legs reduces the useable screen area. It is the Applicant's understanding that the Barocas clamp has been commercially discontinued.

It is therefore a primary object of the invention to provide an improved frame protector in the form of a unitary thin wall pliable extruded plastic frame protector body including an integral circular cross-section body portion terminating at one end in an integral, hinged straight arm portion at an angle of about 45° outwardly from a tangent to the first portion at that end and toward a plane defined by the printing screen to facilitate ready pivoting and formation of a vertical wall from the circular cross section first body portion and the printing screen, thereby providing more screening area while still closing voids about the screen printing frame and permitting the use of ordinary masking tape of narrow width to seal the free end of the hinged arm portion to the surface of the printing screen with easy close-off of the printing screen at the periphery and corners of the screen printing frame. The low surface tension of the protector eliminates residue from delamination of the masking tape adhesive.

SUMMARY OF THE INVENTION

The invention is directed to a frame protector for protecting a circular cross-section screen printing frame member, and to protect the printing mesh at the vulnerable area where the mesh is in close proximity to, and/or in contact with the tubular frame member. The protector takes the form of a unitary thin wall pliable extruded plastic frame protector body including a first, integral circular cross-section body portion having an internal radius equal to the outside radius R of the frame member and extending about 270°, thereby defining an open mouth to receive the frame member. The body portion of the frame protector is complementary to the contour of the frame member and sized to the outer periphery of the frame member for making contact therewith. The frame protector body further includes a second, integral straight base portion extending from a first end of the body portion and tangentially outwardly from the first circular cross-section body portion for underlying a peripheral edge of a printing screen mounted to and within the screen printing frame. The frame protector body further includes a third, integral straight arm portion hinged to and extending away from the second end of the body portion at an angle of about 45° from the tangent to the first portion of the frame protector body at the second end in the direction of a plane defined by the printing screen.

In one embodiment, the second straight base portion of the frame protector body has a length equal to the radius R and the hinged third, straight arm portion, has a length equal to the hypothenuse of a 45° triangle whose two opposite sides are equal to the radius R of the circular cross-section frame member.

In another embodiment, the hinged third, straight arm portion has a length from its hinged connection to the first portion to a free edge thereof at least equal to the radius R of the cylindrical cross-section frame member.

In one embodiment, the second, integral straight base portion extends from an end of the first portion tangentially outward from the first body portion over a length equal to the radius R of the cylindrical cross-section frame member.

In one embodiment, the plastic frame protector body is of reduced thickness at the juncture between the third, integral straight arm portion and the second end of the first portion to form a first hinge such that the third arm portion may be freely pivoted about the first hinge into vertical position and in contact with the printing screen at a distal end remote from said first hinge.

In another embodiment, the third, hinged straight arm portion includes a localized longitudinal area of reduced thickness adjacent the distal end to form a second hinge for hinging a terminal section of the third arm portion to a right angle straight arm portion to either side thereof, thereby defining a flap which may be tape sealed to the printing screen in the vicinity of the frame member.

In a further embodiment, the hinged straight arm portion may further include a third localized longitudinal area of reduced thickness proximate to the first hinge forming a third hinge to increase the angle of pivot of the third, hinged arm portion about the second end of the first, integral circular cross-section body portion without interference from the presence of the frame member.

In another embodiment, the third, hinged straight arm portion terminates at a distal end remote from the first hinge in an integral right angle flap extending outwardly in a direction away from the second base portion and wherein the length of the third, hinged straight arm portion to the right angle flap is equal to the radius R of the circular cross-section frame member such that with the third, hinged straight arm portion extending at right angles to the plane of the second, integral, straight base portion, the straight arm portion forms a vertical dam for blocking entry of printing ink into a void between the printing screen and the periphery of the screen printing frame member.

In further embodiments of the invention, the hinged, third straight arm portion of the frame protector body may terminate remote from the proximate end hinge connection to the first, integral circular cross-section body portion in an integral T-molding defining opposite direction dual flaps including an outboard flap at 90° for tape sealing to the underlying printing screen, and an inboard flap at an acute angle to the third, hinged straight arm portion of a length less than the radius R of the circular cross-section frame member to permit the inboard flap to rest against the tubular frame member thereby stabilizing the hinged straight arm section. If the inboard flap was made planar to the opposite flap and was slightly shorter than R it could tuck into the tangentially formed gap between the exterior of the circular cross-section frame member and the facing surface of the printing screen thereby stabilizing the hinged straight arm section. As in the other embodiments when the third straight arm portion, 16, is made vertical as shown by the dotted lines in FIG. 2, it closes off cavity area C under the tubular frame.

A more detailed explanation of the invention is provided in the following description and claims taken in conjunction with the accompanying drawings.

DETAILED DESCRIPTION OF THE PREFERRED EMBODIMENTS

Figure 1:
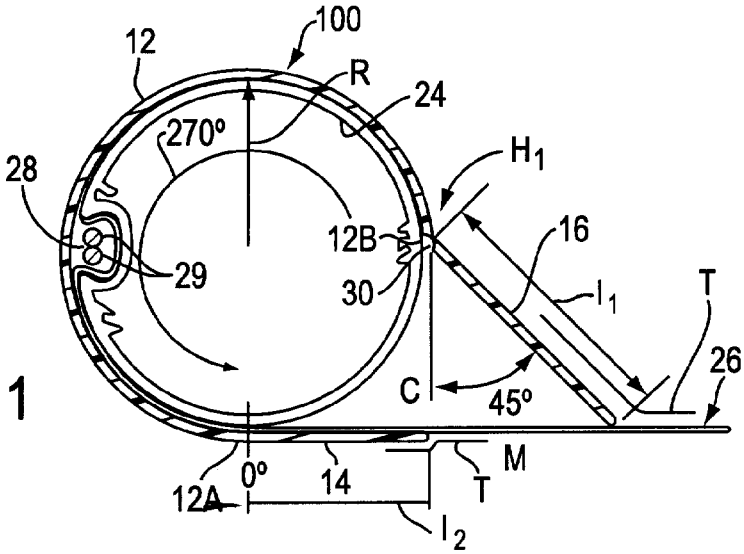
FIG. 1 is an end view of a frame protector mounted to a cylindrical tubular metal frame member forming a first embodiment of the invention.

The frame protector of the present invention in all six embodiments may be employed in conjunction with a printing screen frame such as that set forth in FIG. 1 of U.S. Pat. No. 5,327,828 to Barocas et al. discussed above, and the content of that drawing figure is incorporated herein by specific reference.

Turning to drawing FIG. 1, a tubular metal frame member 24 of an exterior radius R, preferably formed of aluminum, concentrically mounts a frame member engageable frame protector indicated generally at 100. The unitary, thin wall, pliable extruded plastic frame protector 100 includes a first, integral, circular or arcuate cross-section body portion 12 having a radius equal to radius R and extending about 270° of the periphery of screen printing frame member 24, thereby forming a mouth indicated generally at M to receive the frame member when the circular body portion 12 has its free end portions flexed away from each other to enlarge mouth M to a width in excess of the outside diameter of the frame member 24.

The circular body portion 12 is complementary and sized to the outer periphery of the frame member 24 such that the protector body portion is placed in mating contact with the exterior of frame member 24. A second, integral, straight base portion 14 of the extruded plastic frame protector extends outwardly from a first end 12A of the body portion 12 in a direction tangential to the circular cross-section body portion 12. A third, integral, hinged straight arm portion 16 extends outwardly from the second end 12B of the arcuate frame protector first portion at an angle of about 45° to the tangent to the first portion at that second end 12B. Portion 16 has a first, proximate end and a second, distal end and is of a length which is in excess of the radius R of the circular cross-section frame member 24. In overcoming the problems of the Barocas type of protector designed to clamp the arcuate body to the outer periphery of the frame member and also clamp the paired lips to opposite sides of the printing screen mesh, in the present invention it was determined that there was no need or dependency on any clamping pressure closure on either the frame member or the mesh screen itself. In the achievement of flexibility, a desired characteristic or property of the frame protector of the present invention, the Applicants determined that the choice of extruded plastic material instead of being extremely stiff, thick and highly resilient detracted from the desired flexibility, and that a highly pliable and relatively soft plastic material with significantly reduced resiliency facilitated instant coupling, maintained its angular position on the tubular frame member, with position secured by the simple use of common narrow masking tape.

Indeed, during initial experimentation in reaching the embodiments of the invention of FIGS. 1–6, it was determined that an extrudable plastic material having a definite memory is not essential to connect the frame protector to the tubular aluminum or other metal frame member and to tape the same into appropriate position by a tape connection between an arm of the extruded frame protector and a facing surface of the printing screen mesh. While different plastic materials may be employed, the various embodiments of the present invention as illustrated in FIGS. 1–6 are preferably of a relatively soft polyethylene, known to be virtually impervious to most inks and solvents used today, having significantly reduced resilience in comparison with the Barocas et al. device, made from rigid PVC having poor solvent resistance, with the wall thickness of the extruded material about 0.040 inch in contrast to the 0.06 inch wall thickness of the Barocas et al. device. As such, the extruded C-shaped protector 100 of FIG. 1 may be readily cut or shaped with a pair of scissors. Further, any extreme rigidity, stiffness or thickness in frame protectors act adversely by preventing the screen printing area from coming into contact with that which is being printed, as well interfering when the sensitized printing screen is being exposed during photographic processing, common in the screen printing industry. These problems persisted in the use of the commercially marketed version of the Barocas et al. frame protector. In the first embodiment of the invention as per FIG. 1, to avoid all problems with taping of the frame protector 100 in place concentrically mounted on tubular frame member 24 with the printing screen 26 of fine mesh fixed at its outer periphery within a shaped groove 28 on that periphery and via a groove receiving locking strip/s 29, FIG. 1, it was preferable to make the length $l_1$ of hinged arm portion 16 the equivalent to the hypothenuse of a 45° right triangle having opposed legs equal to the exterior radius R of the tubular frame member 24 to which the protector is mounted and attached. Thus, the arm portion 16 has a length equal to the radius R of the tubular frame member 24 times 1.414. In theory, this permits the arm portion 16 to extend downward at 45° and outwardly of the frame member to meet the printing screen. In the improved frame protector, the outboard end of the base portion 14 was taped by a narrow strip of masking tape T to the bottom surface of the mesh screen 26 while the distal end of the arm portion 16 was similarly taped by a second strip of masking tape T. The length $l_2$ of the base portion 14 of the extrusion was found to be best where its length was approximately equal to radius R of the frame member 24 at its outer periphery.

With the extruded frame protector being formed of polyethylene, it was determined that the arm of a length equal to the radius R times 1.414 would not under some circumstances quite reach the printing screen. In trying to bend arm portion 16 downward so that its free end touches the printing screen 26, the slippery polyethylene frame protector was found to tend to rotate on the tubular frame member 24, creating problems in taping the free ends of the extruded frame protector 100 to opposite surfaces of the printing screen 26 mesh. This was caused by resistance to flexing experienced at the point where the annular first portion of the frame protector 12 meets the arm 16.

To eliminate that problem, by molding in an elongated longitudinal groove 30 on the radially inner or outer surface or scoring the face of the plastic frame protector 100 after extrusion, the plastic extrusion would be noticeably thinner at this junction, the result of which creates a first hinge $H_1$ as per FIG. 1. As a result, the arm portion 16 may be readily pivoted about hinge $H_1$, i.e., along the line of reduced thickness longitudinally from end-to-end through an angle of 180°, i.e., 90° to each side of the hinge $H_1$. As a result, the arm portion 16 may be easily pivoted or bent radially inward or outward without much resistance and without the entire protector 100 wanting to rotate on the tubular frame member 24. As a result, in the embodiment of FIG. 1, utilizing the scored line or groove 30 on the radially inner or outer surface of the frame protector 100 at the juncture of the arcuate body portion 12 and the proximate end of arm portion 16 permits the arm portion and the mesh to be taped together without any residual or latent strain in the joint at 30 or dislocation of the protector 100 circumferentially on the exterior of the tubular frame member 24. Alternatively, in all embodiments of the invention a hinge, or multiple hinges, may be formed by extruding a narrow section of the arm at a desired hinge location with a material of softer durometer hardness than the remainder of the extrusion. Further, instead of groove, a series of longitudinally spaced perforations may define a weakened portion of the extruded arm and facilitate a hinging action.

FIGS. 2–6 illustrate modifications of the basic invention of FIG. 1. Drawing FIGS. 2–6 are end views of various extruded frame protectors, all of which mount similarly to that shown in FIG. 1, but having modified extruded portions. The inclusion of additional score lines or grooves facilitate the mounting of the frame protectors on the frame member and the taping of hinged members, as well as the lower straight base portion to respective opposite surfaces of the printing screen mesh in the vicinity of the frame member 24. In the various embodiments, like numerals have been employed for like members. In all cases of the embodiments of FIGS. 2–6, the base portion 14 has a length equal to the radius R of the tubular frame member to which the frame protector in question is coupled and ends of the protector are tape attached to opposite sides of the printing screen mesh material.

Figure 2:
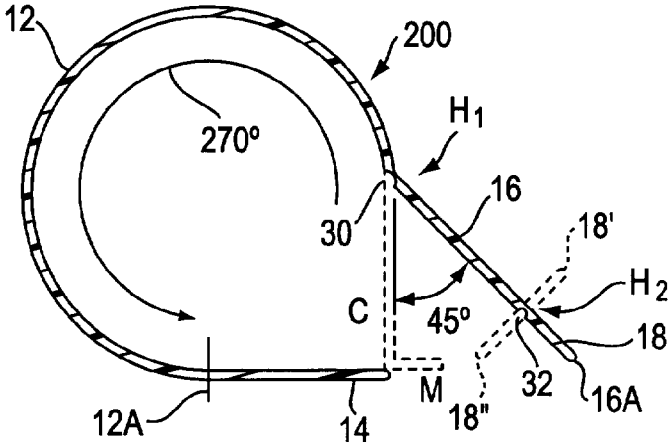
FIG. 2 is an end view of a frame protector forming a second embodiment of the invention.

In the embodiment of FIG. 2, in addition to a first groove 30 forming a first hinge $H_1$ at the junction between the arcuate body portion 12 and arm 16, a second groove or score line is provided at 32 on the radial interface of the arm portion 16 remote from the distal end 16A of the arm creating a pivotable flap 18. Flap 18 may be pivoted 90° to the outside of the frame protector 200 of this embodiment, as shown in dotted lines at 18', or diametrically opposite facing inwardly as at 18". The groove or score line 32 forms thus a second hinge $H_2$. In bending the flap 18 outwardly or inwardly, the overall arm portion takes the form of an L. This advantageously provides a vertical wall when arm portion 16 at hinge $H_1$ is rotated approximately 45° to a vertical position, closing off the cavity C, conforming to that at C, FIG. 1, beneath the tubular frame member 24 by the mesh 26 and the content of arm portion 16. Additionally, without pivoting of flap 18 at hinge $H_2$, it may function identically to that of the embodiment of FIG. 1. Further, with the flap 18 pivoted to the dotted line position to the inside, as at 18", the hinge flap 18 may contact the upper surface of the screen mesh. Further, with the arm portion 16 swung slightly beyond a 45° angle, that is beyond the vertical, to the inside of the assembly, the arm portion 16 locks onto the mesh at a point where the printing screen mesh overlies base portion 14. As such, the reduced length arm portion 16 in the embodiment of FIG. 2 permits the flap 18 to be reverse tucked under the tubular frame member. By suitable taping, a seal is formed to prevent ink seepage into the cavity corresponding to that at C, FIG. 1. This reverse tucking of flap 18 exposes additional printing area.

Figure 3:
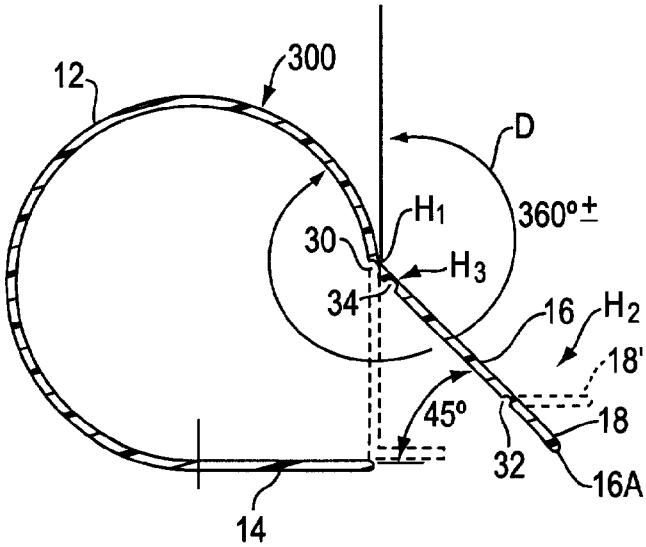
FIG. 3 is an end view of a frame protector forming yet a third embodiment of the invention.

FIG. 3 illustrates a slight modification over the embodiment of FIG. 2, in which the frame protector indicated generally at 300 includes not only a first molded in groove or score line 30 forming hinge $H_1$, and a second groove or score line at 32 forming hinge $H_2$ in the manner of the embodiment of FIG. 2, but a third score line or groove 34 just below groove or score line 30 and thereby defining a localized reduced thickness portion over the length of the extrusion, forming a third hinge $H_3$. In the illustrated embodiment, a distance of about ⅛ inch between grooves or score lines 30 and 34 has been deemed satisfactory. This creates a second hinging point or area in the advent that the circumference of the annular body portion 12 is of insufficient length to allow the first hinge $H_1$ to end up short of opposing the 270° mark on the tubular frame. The slightly lower hinge $H_3$ then takes over the function of the upper hinge $H_1$ and prevents the protector 11 from being pried away from the tubular frame 24 by the fulcrum action of arm portion 16 rotating about the first hinge $H_1$. As may be appreciated, this permits the arm portion 16 to rotate itself in excess of 270° as indicated by arrow D, FIG. 3. The flap 18 is shown in FIG. 3 as being pivoted to a near horizontal position about 45° from that shown in full lines. Such hinge $H_2$ permitting relatively free pivoting through an arc of approximately 180° conforming to that of the embodiment of FIG. 2.

Figure 4:
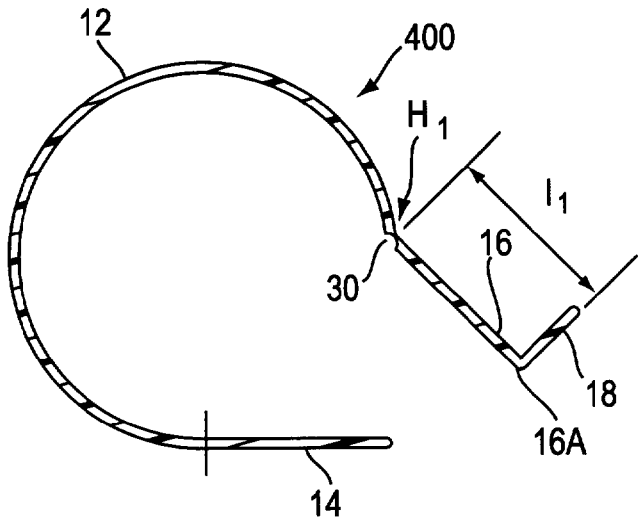
FIG. 4 is an end view of a frame protector forming a fourth embodiment of the invention.

Turning to the embodiment of frame protector at 400, FIG. 4, this embodiment includes a single hinge $H_1$ defined by a groove or score line 30 on the interior face of the extrusion at the juncture of the proximate end of arm portion 16 and the circular cross-section body portion 12. While the extrusion includes arm portion 16, again at an extrusion angle of an angle approximately 45° to the tangent at the juncture between portions 12, 16, the length of the arm portion 16 is shorter than that of the prior embodiments of FIGS. 1–3, with an integral non-hinged flap 18 being relatively rigidly molded at 90° to the arm 16 at its distal end 16A. Preferably, the length $l_1$ of that arm portion is equal to the radius R of the tubular frame member 24 such that pivoting the arm portion 16 about hinge $H_1$ permits the arm portion 16 to move to a vertical position with at least a portion of the integral relatively rigid flap 18 in contact with the underlying printing screen 26 at a point where it overlies the base portion 14 of the extrusion. As such, the flap 18 is ready for taping to the upper surface of the mesh printing screen, while the outboard end of the base section 14 may be taped readily to the bottom surface of the mesh screen at the same or an adjacent point.

Figure 5:
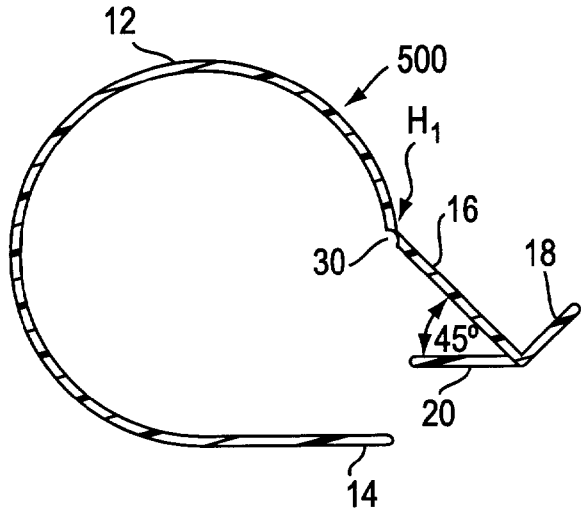
FIG. 5 is an end view of a frame protector forming a fifth embodiment of the invention.

FIG. 5 is directed to a further embodiment of the frame protector, indicated generally at 500, which is a variation of that of FIG. 4. In this case, in addition to a relatively rigid molded in flap 18 at 90° to the axis of the arm portion 16, there is a molded in, relatively rigid second flap 20 which projects outwardly from arm portion 16 in an opposite direction to that of flap 18 and at an angle of 45° to the axis of the arm portion 16. The second fixed flap 20 opposite to flap 18 preferably has a length equal to 0.414 times the radius R of the tubular frame member 24, FIG. 1, such that the free end of the second flap 20 acts as a stop and comes to rest against the tubular frame member 24 outer periphery when the L-shaped portion comprised of arm portion 16 and rigid flap 18 pivots downwardly such that the arm portion 16 is perpendicular to the plane of the printing screen 26 when the frame protector 500 is mounted in place of protector 100 in the assembly of FIG. 1. Flap 20 therefore acts as an extension of an imaginary radii projecting from the center of the tubular frame member at an 45° angle as measured off perpendicular to the printing screen 26.

Figure 6:
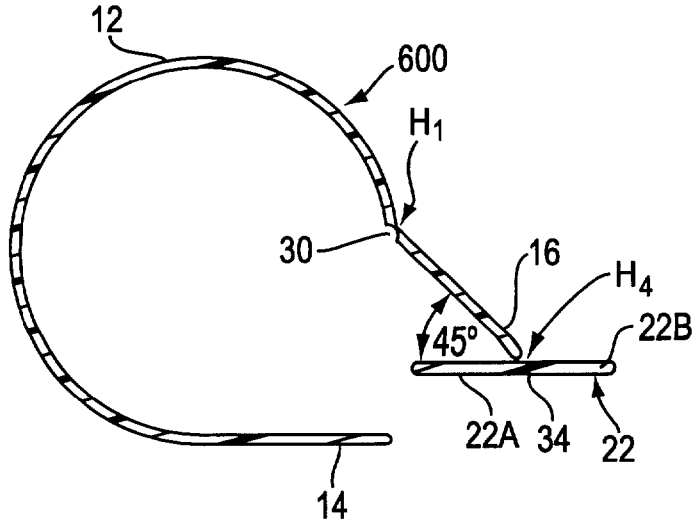
FIG. 6 is an end view of a frame protector forming another embodiment of the invention.

Referring next to FIG. 6, the frame protector indicated generally at 600 is a further modification of the embodiment of FIG. 5. In this case, a unitary, double flap member or crosspiece 22 is integrally molded under conditions in which a groove 34 forms a fourth hinge joint $H_4$ at the distal end 16A of arm portion 16 such that hinges $H_1$ and $H_4$ are at diametrically opposite ends of the arm portion. The double flaps of crosspiece 22 are coplanar, but not of equal length. The longer section 22A to the left is of a length slightly less than the radius R of the tubular frame member 24, FIG. 1, being reduced in length by approximately 10% or less, so that the section 22A to the left can be tucked into the tangential void created between the printing screen 26 and the point where the mesh printing screen 26 touches and is wound onto the outer periphery of the tubular frame member 24. When mounted to the frame member 24 in place of frame protector 100, the frame protector 600 has section 22A of the double flap or cross piece 22 entering cavity C, FIG. 1.

Section 22B of the cross piece 22 may be taped to the upper surface of the printing screen 26, with the longer left hand section 22A being wedged into the tangentially formed gap between base section 14 and the outer periphery of the tubular frame member 24 above the surface of the screen 26. This approach provides significant support for the vertical wall defined by arm portion 16 when rotated from its 45° oblique position shown, to vertically upright on the screen mesh.

It should be appreciated that the presence of the first hinge $H_1$ permits the hinged arm portion 16 to be rotated or swung from its extruded oblique position to a tangent at the connection point of the hinge to the frame protector circular cross-section first portion 12 to a vertical position or through the vertical position to an opposite side inclination. Further, by using a second hinge, it is possible to have a stable vertical wall defined by the pivotable arm portion 16 as an aspect of the tubular frame member, thereby enlarging the printing screen area and giving the screen more versatility, all in a single unitary extruded protector such as that in the embodiment of FIG. 2 at 200. Thus, the wall defined by the frame protector, and particularly the double hinged arm portion 16 of FIG. 2 may have a 45° angle slope, be vertically upright or somewhere inbetween, all achieved using the two hinges $H_1$, $H_2$.

In this invention, polyethylene is the preferred plastic material for extrusion. While it is not the easiest to extrude in these profiles, it is highly appropriate because of its resistance to many solvents. Further, its use is enhanced by its flexibility, durability and light weight. Fabrication of the protector can be done in the screen shop using only scissors and common masking tape. No sawing or fancy and dangerous cutting machines are required. The single, double or triple hinged extruded plastic protector in the various embodiments is easy to use and can be readily attached, as well as removed from the screen assembly when the job is done and reused again and again.

It should be apparent that changes and modifications can be made without departing from the spirit of the invention. For instance, while it is desirable that the grooves forming the various hinges be part of the extrusion process, scoring of the plastic extrusion along parallel lines on either face of the extruded protector can be effected after extrusion to create reduced thickness and integral hinges functionally and structurally the equivalent to those created by the extrusion mold. Further, while multiple embodiments of the invention have been shown and described, it should be understood that various modifications and substitutions can be made by those skilled in the art without departing from the scope of this invention as set forth in the claims appended hereto.

What is claimed is:

1. A unitary, thin wall, pliable, extruded plastic frame protector for protecting a circular cross section screen printing frame member, and for protecting the printing mesh at the vulnerable area where the mesh is in close proximity to, or in contact with the frame member, said protector including an integral, body portion of circular cross-section having a radius R equal to the exterior surface radius of said frame member extending about 270°, thereby defining a mouth to receive said frame member, said body portion being complementary to the contour of the frame member and sized to the outer periphery of the frame member for mating contact therewith, an integral, straight base portion extending from a first end of said body portion and tangentially outwardly therefrom for underlying a peripheral edge of a printing screen, and an integral, straight arm portion extending from a second end of said body portion at an angle of about 45° outwardly from the tangent to said body portion of said second end toward a plane defined by said printing screen, said straight base portion having a length at least equal to the radius R, and said arm portion having a length at least equal to radius R, and said extruded plastic frame protector further comprising a first hinge coupling a proximate end of said arm portion to said one end of said body portion to facilitate pivoting of an opposite, distal end of said arm portion into contact with the surface of said printing screen mesh.

2. The frame protector as claimed in claim 1, wherein said first hinge comprises a longitudinal linear area of reduced thickness within said unitary, thin wall, extruded plastic frame protector.

3. The frame protector as claimed in claim 2, wherein a longitudinal groove is formed within a face of said thin wall extruded plastic frame protector forming said reduced thickness linear area constituting said first hinge.

4. The frame protector as claimed in claim 1, wherein said length of said arm portion is equal to a hypothenuse of a right triangle whose two opposite sides have a length equal to said radius R.

5. The frame protector as claimed in claim 1, wherein said hinged arm portion has a length generally equal to the radius R, with the distal end of said arm portion contacting the facing surface of said screen printing mesh when said arm portion is moved into a position perpendicular to the plane of said screen printing mesh.

6. The frame protector as claimed in claim 1, further comprising a second hinge within said arm portion proximate to the distal end of said arm portion and forming a pivotable flap for pivoting into a position extending outwardly from said arm portion to facilitate taping of said flap to said surface of said printing screen mesh.

7. The frame protector as claimed in claim 6, wherein the length of said arm portion from said first hinge to said second hinge is of a length generally equal to said radius R.

8. The frame protector as claimed in claim 1, further including a third hinge within said arm portion spaced from said first hinge, but proximate thereto to facilitate pivoting of said arm portion to bring the distal end of said arm portion in contact with the surface of said printing screen mesh irrespective of limited circumferential shifting of said first circular section body portion about the periphery of said screen printing frame member.

9. The frame protector as claimed in claim 1, wherein said arm portion is of L-shaped plan configuration including a molded in, relatively rigid flap extending outwardly, to one side of said arm portion at the distal end thereof.

10. The frame protector as claimed in claim 9, wherein said relatively rigid flap is at a right angle to the axis of the arm portion from a proximate end to said distal end.

11. The frame protector as claimed in claim 1, wherein said arm portion is substantially T-shaped having a molded in relatively rigid cross piece at said distal end with sections of said cross piece extending to opposite sides of said arm portion.

12. The frame protector as claimed in claim 11, wherein said cross piece is hinge connected to a major portion of said substantially T-shaped arm portion at said distal end.

13. The frame protector as claimed in claim 11, wherein said cross piece includes a section extending outwardly at said distal end of said arm portion perpendicular to the arm portion and a section extending inwardly towards the body portion defining an acute angle with the arm portion.

14. The frame protector as claimed in claim 11, wherein said cross piece is formed of a short length first section extending away from said body portion and a longer length second section extending in the direction of said body portion.

15. The frame protector as claimed in claim 1, wherein said extruded plastic frame protector is of a resilient plastic material.

16. The frame protector as claimed in claim 15, wherein said resilient plastic material is polyethylene.

17. The frame protector as claimed in claim 1, wherein a longitudinal groove is formed within a face of the unitary, thin wall, pliable, extruded plastic frame protector defining said first hinge.

18. The frame protector as claimed in claim 17, wherein said longitudinal groove is molded into a face of said thin wall, pliable, extruded plastic frame protector.

19. The frame protector as claimed in claim 1, wherein said hinge is formed of a narrow section of said plastic frame protector of a softer durometer hardness than the remainder of said extruded plastic frame protector.

* * * * *